US005692489A

United States Patent [19]

Swanson et al.

[11] Patent Number: 5,692,489

[45] Date of Patent: Dec. 2, 1997

[54] METHOD AND APPARATUS FOR A MOTORIZED REPEATING TOY GUN

[75] Inventors: Matthew D. Swanson, 878 Hoffman Terr., Los Altos, Calif. 95024; David N. Powers, Los Altos, Calif.

[73] Assignee: Matthew D. Swanson, Los Altos, Calif.

[21] Appl. No.: 566,001

[22] Filed: Dec. 1, 1995

[51] Int. Cl.[6] ..... F41B 7/02

[52] U.S. Cl. ..... 124/19

[58] Field of Search ..... 124/18, 19

[56] References Cited

U.S. PATENT DOCUMENTS

| | | | |
|---|---|---|---|
| D. 247,986 | 5/1978 | Clyde | D34/15 PT |
| D. 305,252 | 12/1989 | Nielson et al. | D21/147 |
| 1,909,927 | 5/1933 | Beauchamp et al. . | |
| 2,021,776 | 11/1935 | Hagen | 124/19 |
| 2,576,248 | 11/1951 | Wright et al. | 124/19 |
| 2,625,147 | 1/1953 | Eagleson, Jr. | 124/19 |
| 2,878,802 | 3/1959 | Kuch | 124/19 |
| 2,917,037 | 12/1959 | Henderson | 124/19 |
| 3,536,055 | 10/1970 | Endo | 124/18 |
| 3,745,986 | 7/1973 | Crowson | 124/17 |
| 3,919,996 | 11/1975 | McAlister | 124/19 |
| 4,308,850 | 1/1982 | Hunter | 124/19 |
| 4,379,445 | 4/1983 | LoBiondo | 124/19 |
| 4,554,904 | 11/1985 | Endo | 124/18 |
| 4,676,219 | 6/1987 | Miller | 124/19 |
| 4,800,864 | 1/1989 | Small | 124/19 |
| 4,827,892 | 5/1989 | Vandermeide | 124/19 |
| 5,170,770 | 12/1992 | Vosloh | 124/19 |
| 5,205,266 | 4/1993 | Kilby, Jr. | 124/19 |
| 5,222,472 | 6/1993 | Landingham | 124/19 |
| 5,460,150 | 10/1995 | Joppe | 124/19 |

*Primary Examiner*—John A. Ricci
*Attorney, Agent, or Firm*—Fenwick & West LLP

[57] ABSTRACT

A system and method for a motorized repeating toy gun. The toy gun includes a base having a first end and a second end upon which elastic rings are stretched and mounted. The toy gun also includes a motor and a spool. The spool has a wrapping portion, is rotatably mounted on the base and is rotatably responsive to the motor. Additionally, the toy gun includes a string. A first portion of the string is positioned around the wrapping portion. A second portion of the string is interwovenly positioned between the second end and each of the elastic rings. The string forcibly wrapped around the spool in response to the operation of the motor, causing the elastic rings to dismount from the second end. Elastic rings, e.g., rubber bands, are loaded onto a base, e.g., a magazine, by stretching each rubber band over the extremities of the base with the string interwovenly placed between the base and the rubber band, such that when the string is pulled toward the spool the rubber band is moved over one of the base extremities and is discharged. The user activates a trigger mechanism that employs a motor to automatically rotate a spool. One end of the string is securely attached to the spool. When the spool rotates, the string is pulled toward, and wraps around, the spool. As the string is pulled toward the spool, the previously loaded rubber bands are sequentially pulled over one of the restricting extremities, resulting in the discharge of the rubber band. The speed of the discharged rubber band is a function of the energy previously stored when the rubber band was stretched. The rubber bands continue discharging until all rubber bands are discharged, the trigger mechanism is deactivated, or a predetermined number of rubber bands are discharged.

16 Claims, 4 Drawing Sheets

METHOD AND APPARATUS FOR A MOTORIZED REPEATING TOY GUN

BACKGROUND OF THE INVENTION

1. Field of the Invention

The present invention relates to the field of toy guns, more particularly to motorized toy guns for repeated shooting of elastic rings.

2. Description of Background Art

Conventional toy guns permit a user to shoot or discharge elastic rings, e.g., rubber bands, or other similar projectiles. However, these conventional toy guns have several limitations. One such limitation is that a user must repeatedly activate a trigger mechanism in order to discharge each rubber band. Conventional trigger mechanisms require that a trigger be activated, e.g., squeezed, in order to discharge a rubber band. In order for a user to discharge multiple rubber bands, the conventional trigger mechanism must be repeatedly activated by the user. That is, the trigger mechanism must be activated, e.g., squeezed or turned, for each rubber band discharge. Repeatedly activating such a trigger mechanism is slow and tedious.

An additional drawback of conventional toy guns is that the trigger mechanism is manually activated. As described above with reference to the trigger mechanism, manual activation is slow and may be difficult for some users.

Other conventional toy guns require two hands to operate. For example, the toy gun disclosed in U.S. Pat. No. 4,676,219 to Miller requires the user to secure a pistol frame with one hand and activate a trigger mechanism with the other hand. Requiring two hands to operate the toy gun is undesirable. It is preferred that a toy gun can be easily operated using only one hand to both secure the toy gun and activate the trigger mechanism.

What is needed is a toy gun that (1) utilizes a trigger mechanism that permits a user to discharge many rubber bands in a single trigger activation; (2) employs a motor to permit a fast and controlled discharge of rubber bands; (3) permits a user to operate the toy gun with one hand; (4) enables hundreds of rubber bands to be consecutively fired without reloading; and (5) is inexpensive to manufacture.

SUMMARY OF THE INVENTION

The present invention is a method and apparatus for a motorized repeating toy gun. The toy gun includes a base having a first end and a second end upon which elastic rings are stretched and mounted. The toy gun also includes a motor and a spool. The spool has a wrapping portion, is rotatably mounted on the base and is rotatably responsive to the motor. Additionally, the toy gun includes a string. A first portion of the string is positioned around the wrapping portion. A second portion of the string is interwovenly positioned between the second end and each of the elastic rings. The string forcibly wrapped around the spool in response to the operation of the motor, causing the elastic rings to dismount from the second end.

Elastic rings, e.g., rubber bands, are loaded onto a base, e.g., a magazine, by stretching each rubber band over the extremities of the base with the string interwovenly placed between the base and the rubber band, such that when the string is pulled toward the spool the rubber band is moved over one of the base extremities and is discharged. The user activates a trigger mechanism that employs a motor to automatically rotate a spool. One end of the string is securely attached to the spool. When the spool rotates, the string is pulled toward, and wraps around, the spool. As the string is pulled toward the spool, the previously loaded rubber bands are sequentially pulled over one of the restricting extremities, resulting in the discharge of the rubber band. The speed of the discharged rubber band is a function of the energy previously stored when the rubber band was stretched. The rubber bands continue discharging until all rubber bands are discharged, the trigger mechanism is deactivated, or a predetermined number of rubber bands are discharged.

DETAILED DESCRIPTION OF THE PREFERRED EMBODIMENTS

Several preferred embodiments of the present invention is now described with reference to the figures where like reference numbers indicate identical or functionally similar elements. Also in the figures, the left most digit(s) of each reference number correspond(s) to the figure in which the reference number is first used.

Figure 1:
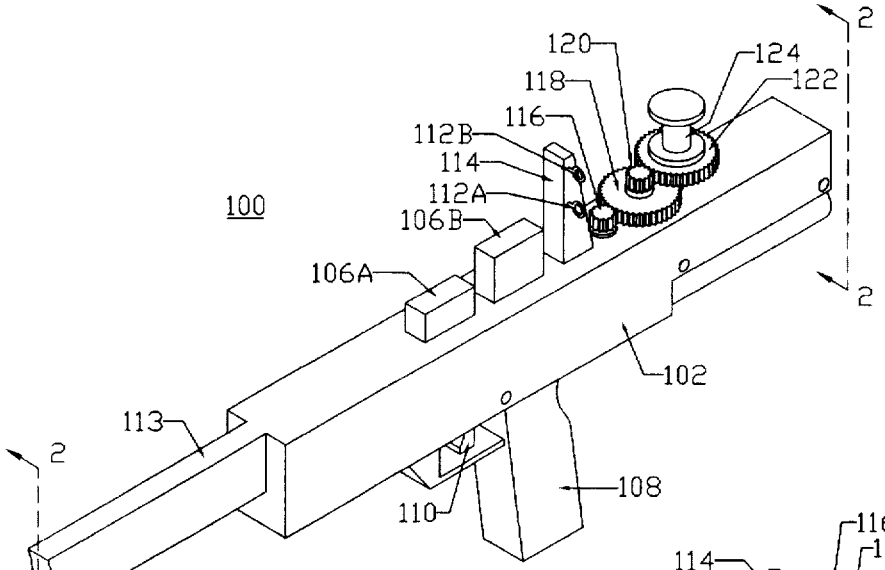
FIG. 1 is a top front and perspective view of a first embodiment of the toy gun of the present invention.

A description of the first embodiment of the toy gun 100 of the present invention is now described with reference to FIGS. 1–4. FIG. 1 is a top front and perspective view of a first embodiment of the toy gun 100 of the present invention. The toy gun 100 includes a frame (or base) 102 that is made of a sturdy material, e.g., wood, plastic, or metal. At one end of the frame 102 is a muzzle 104. The muzzle 104 is preferably curved in a concave fashion to permit elastic rings, e.g., rubber bands, to be elastically restricted thereupon. Alternatively, the muzzle 104 can be straight or can have grooves to restrict the rubber bands therein. The frame 102 also includes one or more loading blocks 106A, 106B. The loading blocks are preferably made of the same material as the frame 102. The loading blocks 106 are positioned on the frame at a distance away from the muzzle 104 to permit a stretched rubber band to be restricted at one end by the muzzle 104 and to be restricted at the opposite end by the restricting blocks 106. The technique for loading and shooting a rubber band is described in greater detail below with reference to FIGS. 5–7.

The frame 102 also includes two rings 112A, 112B on a support 114. Each ring 112 is preferably made of metal or plastic. The height of the top ring 112B should be greater than the height of the loading blocks 106 with reference to the top of the frame 113. This height differential will permit a string that is threaded through the top ring 112B to lift a rubber band over the loading block 106A, as described below. The frame 102 also includes a gear assembly 116, 118, 120, 122. The gear assembly 116, 118, 120, 122 is coupled to a spool 124. The spool is preferably cylindrical having an outside wrapping portion secured to two spaced-apart discs.

A handle 108 is positioned toward the center of the frame 102. The handle 108 is preferably made from the same material as the frame 102. The top of the handle 108 can form a loading block 106, e.g., loading block 106B. In an alternate embodiment the handle 108 is removable from the frame 102. A trigger 110 is positioned adjacent to the handle to permit operation of the toy gun 100 with only one hand. The operation of the trigger 110 is described in greater detail below with reference to FIG. 2.

Figure 2:
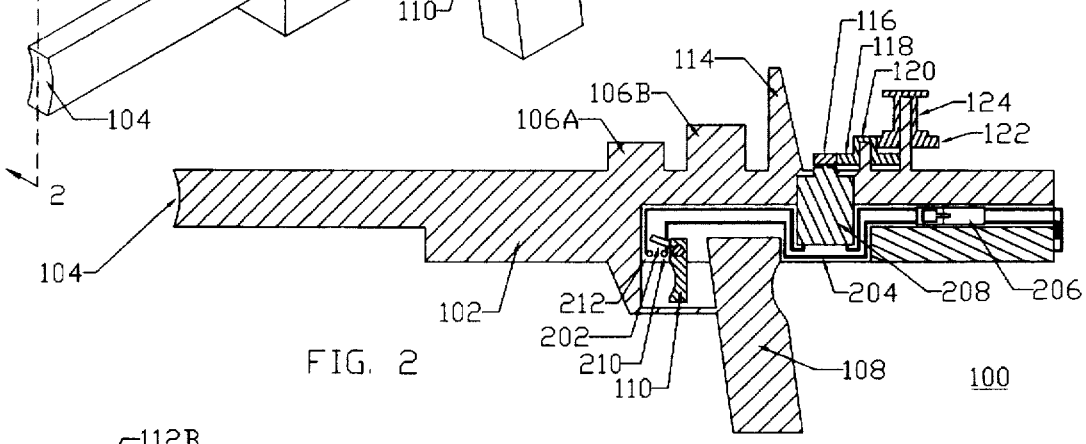
FIG. 2 is a cross-sectional illustration of a first embodiment of the present invention taken along plane 2—2 of FIG. 1.

FIG. 2 is a cross-sectional illustration of a first embodiment of the present invention taken along view-lines 2—2 of FIG. 1. The trigger 110 is connected to a switch 202. When the trigger 110 is pulled, the switch 202 connects a first node 210 with a second node 212. Each node 210, 212 is connected to a wire 204. Node 210 is connected to a power supply 208, e.g., a battery. The power supply 206 provides power to a motor 208 when the circuit is closed by pressing the trigger 110. In the preferred embodiments the motor is an RX 540 TZ Technigold model that is commercially available from Tamiya Plastic Model Company, located in Ondawara, Shizuoka-City, Japan. The motor is connected to a first gear 116 of the gear assembly 116, 118, 120, 122. When power is supplied to the motor, the motor causes the first gear 116 to rotate. The first gear is coupled to the second gear 118. Therefore, the second gear 118 rotates when power is supplied to the motor 208. Similarly, the third gear 120 is coupled to the second gear 118. Therefore, the third gear 120 rotates when power is supplied to the motor 208. The fourth gear 122 is coupled to the third gear 120. Therefore, the fourth gear 122 rotates when power is supplied to the motor 208. The spool 124 is coupled to the fourth gear 122. Therefore, the spool 124 rotates when power is supplied to the motor 208.

Figure 3:
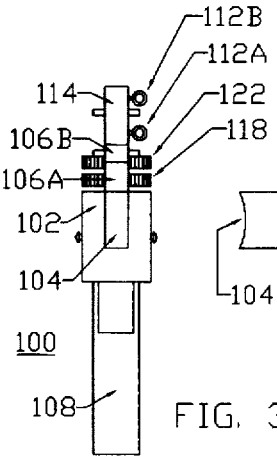
FIG. 3 is a front plan view of the first embodiment of the present invention.

FIG. 3 is a front plan view of the first embodiment of the present invention further illustrating the relationship of the components of the first embodiment of the present invention.

Figure 4:
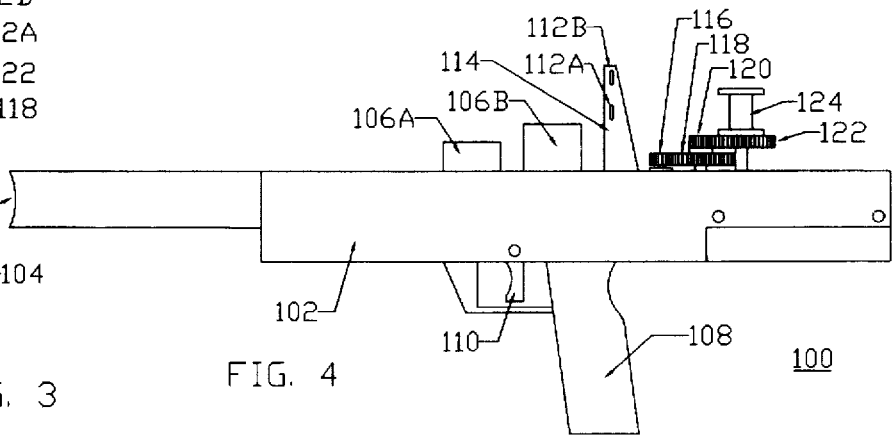
FIG. 4 is a side plan view of the first embodiment of the present invention.

FIG. 4 is a side plan view of the first embodiment of the present invention further illustrating the relationship of the components of the first embodiment of the present invention.

Figure 5:
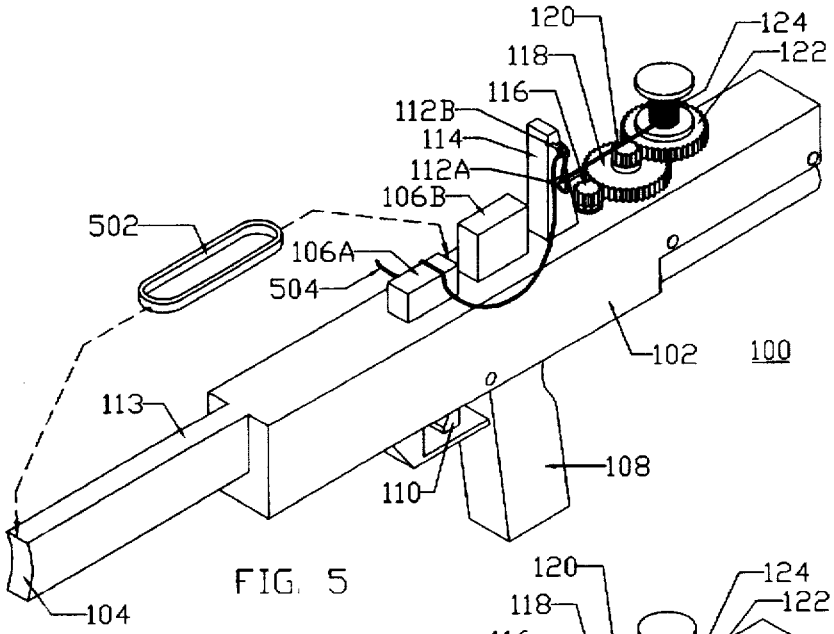
FIG. 5 is a top front and perspective view of the first embodiment of the present invention prior to securing an initial elastic ring thereon.
Figure 6:
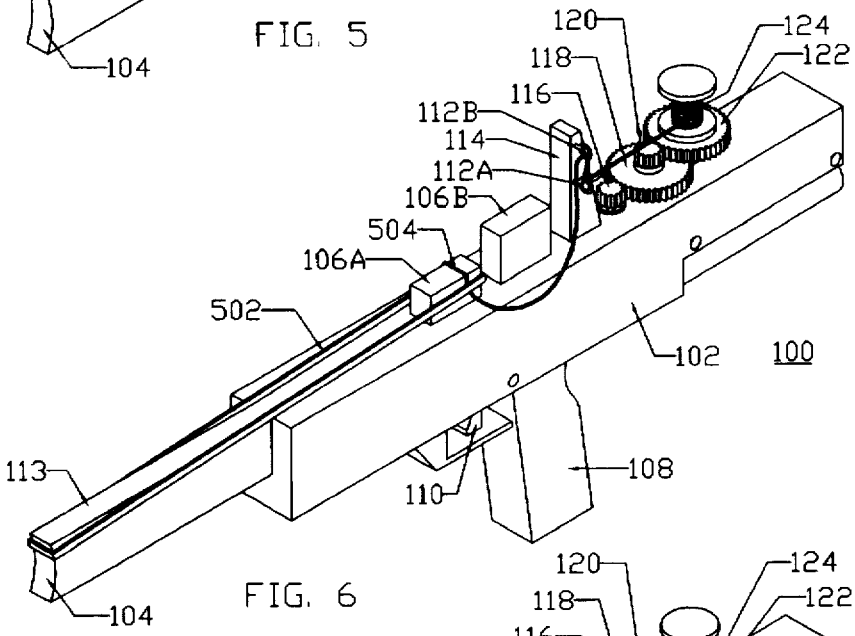
FIG. 6 is a top front and perspective view of the first embodiment of the present invention after securing the initial elastic ring thereon.

The technique for loading and shooting the first embodiment of the toy gun illustrated in FIGS. 1–4 is now described with reference to FIGS. 5–7. FIG. 5 is a top front and perspective view of the first embodiment of the present invention prior to securing a first rubber band 502 thereon. In order to load a rubber band 502 onto the toy gun 100, the string 504, or other similar material, e.g., a cord, ribbon, or fishing line, is secured to the spool 124 by tying one end of the string 504 around the wrapping area of the spool 124. Alternatively, the string 504 can be secured to the spool 124 by placing the one end of the string 504 adjacent to the wrapping area of the spool 124 and turning the spool 124 to cause the string 124 to wrap around the spool 124. As the string 504 is wrapped around the spool 124, a portion of the string 504 is positioned such that the one end of the string 504 is secured between the newly wrapped portion of the string 504 and the spool 124. The other end of the string 504 is threaded through each of the rings 112A, 112B. A lower ring 112A is positioned at a height approximately equal to the vertical height of the center of the spool 124. This facilitates the wrapping of the string 504 around the spool 124 when the toy gun 100 is activated, as described below. A higher ring 112B is positioned at a height greater than the height of the loading blocks 106 to facilitate the discharging of the rubber bands 502 when the toy gun 100 is activated, as described above.

After threading the string 504 through the rings 112, the string is placed across the loading block 106A as illustrated in FIG. 5. In other examples, loading block 106B can be used. A rubber band 502 is loaded by stretching and securing the rubber band 502 around the loading block 106A and the muzzle 104 as shown in FIG. 6. FIG. 6 is a top front and perspective view of the first embodiment of the present invention after securing the initial elastic ring thereon. The rubber band 502 is positioned such that the string 504 is located between the loading block 106A and the rubber band 502. Additional rubber bands 502 are loaded as shown in FIG. 7.

Figure 7:
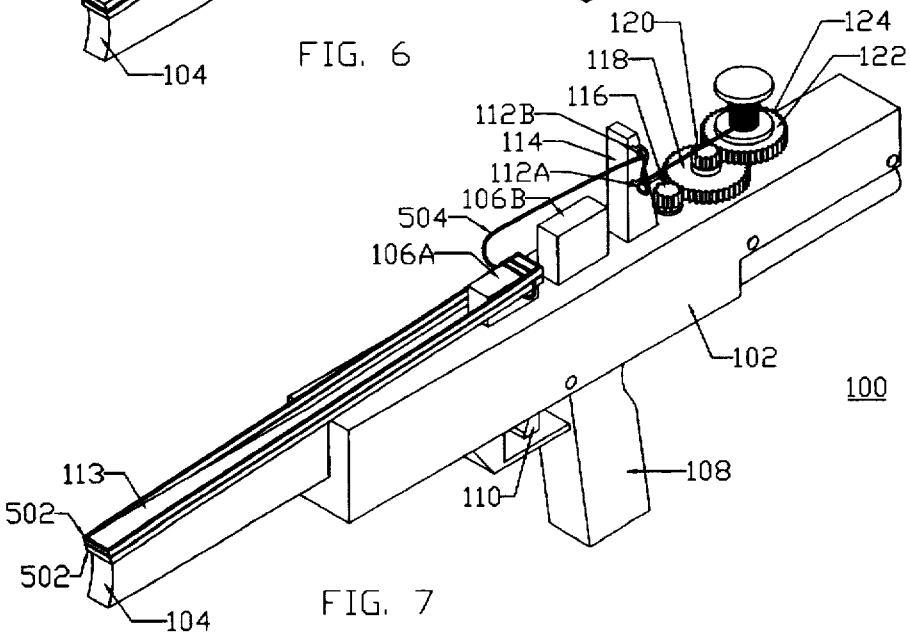
FIG. 7 is a top front and perspective view of the first embodiment of the present invention after securing several elastic rings thereon.

FIG. 7 is a top front and perspective view of the first embodiment of the present invention after securing several elastic rings thereon. A second rubber band 502 is loaded using a similar technique as described above. After loading the first rubber band 502, the portion of the string 504 between the loaded rubber band and the ring 112B is looped on top of the loaded rubber band and the loading block 106A as illustrated in FIG. 7. The second rubber band 502 is loaded by stretching and securing the second rubber band 502 around the loading block 106A and the muzzle 104. Hundreds of rubber bands can be loaded onto the toy gun 100 using the same technique.

The operation of the first embodiment of the toy gun 100 is now described. After loading the rubber bands 502, the toy gun can be activated. A user presses the trigger 110 toward the handle causing the switch 202 to electrically couple the first node 210 with the second node 212. When the first node 210 and the second node 212 are electrically coupled, a current flows through the wires 204, and the power supply 206 provides the required power to activate the motor 208. As described above, the motor 208 is connected to the first gear 116 of the gear assembly. When the motor is activated the motor causes the first gear 116 to rotate. When the first gear 116 rotates, the second gear 118, the third gear 120, and the forth gear 122 of the gear assembly also rotate, as described above. The fourth gear 122 is coupled to the spool 124. In the first embodiment four gears 116, 118, 120, 122 are used. Therefore, when the motor 208 is activated, the spool 124 rotates. The number of gears and the gear ratio can be altered to adjust the speed of rotation of the spool.

As the spool 124 rotates, the additional portions of the string 504 are wrapped around the spool 124. After all slack in the string 504 is exhausted, the rotating spool 124 continues to exert pressure on the string. As described above, between each loaded rubber band 502 is one loop of string 504. Pressure is exerted by the spool onto the last loop of string 504, i.e., the loop of string positioned between the last loaded rubber band 502 and the penultimately loaded rubber band 502. The string 504 is pulled upward toward the second ring 112B and causes the position of the last loaded rubber band to rise with respect to the loading block 106B. At the instant when the height of the last loaded rubber band exceeds the height of the loading block 106B, the loading block 106B no longer exerts a force on the last loaded rubber band. Accordingly, the tension in the stretched rubber band is released. The end of the last loaded rubber band 502 that is secured on the muzzle 104 does not immediately move. Instead, the muzzle 104 acts as an aiming mechanism. The released end of the rubber band 502 will travel toward the muzzle 104 and will travel a significant distance in a direction aligned with the loading block 106A and the muzzle 104. The distance traveled by the rubber band 502 is a function of the elasticity and tension of the loaded rubber band 502.

If the user keeps the trigger 110 pressed, the motor 208 remains activated and the spool 124 continues rotating. As the spool 124 rotates, more string 504 is pulled through the rings 112. Accordingly, additional rubber bands 502 are released, i.e., shot, as the associated loop of string, i.e., the string positioned immediately beneath each rubber band 502, is pulled toward the spool 124. The rate of rubber band discharge is dependent upon the rotating speed of the spool 124 and the amount of string 504 used to load each rubber band 502, i.e., each loop of string. In the first embodiment the firing rate is approximately 10 rubber bands per second. However, with an inexpensive motor 208 and the proper gear ratio, firing rates of over fifty rubber bands per second can be achieved. In alternate embodiments the firing rate of the toy gun 100 can be varied by the user by altering the gear ratio of the gear assembly 116, 118, 120, 122.

Figure 8:
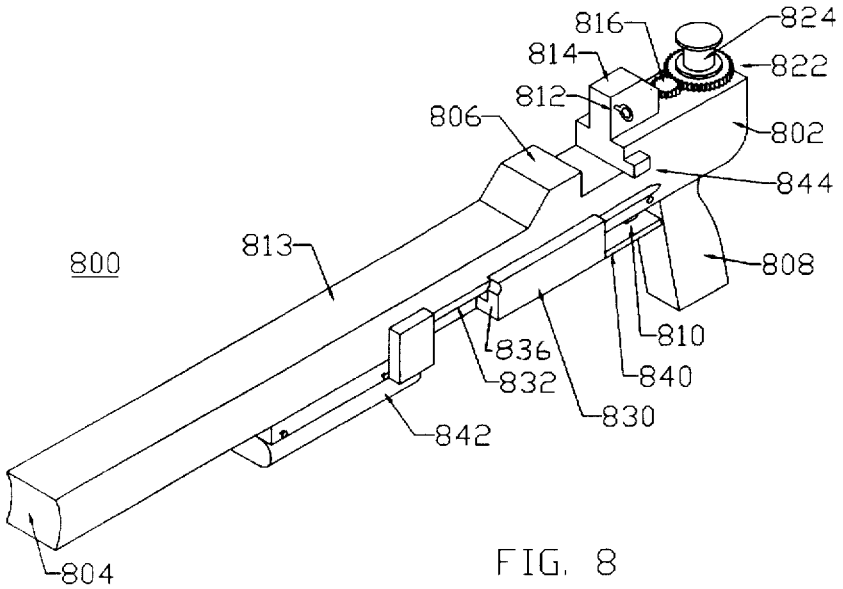
FIG. 8 is a top front and perspective view of a second embodiment of the toy gun of the present invention.

A description of a second embodiment of a toy gun 800 of the present invention is now described with reference to FIGS. 8–10. FIG. 8 is a top front and perspective view of a second embodiment of the toy gun of the present invention. The toy gun includes a frame (or base) 802 that is made of a sturdy material, e.g., wood, plastic, or metal. At one end of the frame 802 is the muzzle 804. The muzzle 804 is preferably curved in a concave fashion to permit elastic rings, e.g., rubber bands, to be elastically restricted thereon. Alternatively, the muzzle 804 can be straight or can have grooves to restrict the rubber bands thereon, as described above with respect to the first embodiment. The frame 802 also includes one or more loading blocks 806. The loading block is preferably made of the same material as the frame 802. Loading block 806 is positioned on the frame at a distance away from the muzzle 804 to permit a stretched rubber band to be restricted at one end by the muzzle 804 and to be restricted at the opposite end by the restricting block 806. The technique for loading and shooting a rubber band according to the second embodiment is described in greater detail below with reference to FIGS. 11–13.

The frame 802 includes a ring 812 on a support 814. The ring 812 is preferably made of metal or plastic. The height of the ring 812 is greater than the height of the loading block 806 with reference to the top of the frame 813. This height differential will permit a string that is threaded through the ring 812 to lift a rubber band over the loading block 806 as the string is pulled. The frame 802 also includes a conventional gear assembly 816, 822. The gear assembly 816, 822 is coupled to a conventional spool 824. The spool 824 is preferably cylindrical having an outside wrapping portion secured to two spaced-apart discs.

A handle 808 is positioned toward the opposite end of the muzzle 804 on the frame 802. The handle 808 is preferably made from the same material as the frame 802. A conventional trigger 810 is positioned adjacent to the handle to permit operation of the toy gun 800 with only one hand. The operation of the trigger 810 is described in greater detail below.

The second embodiment of the toy gun 800 includes a shotgun feature that is described in detail below. To effectuate the shotgun feature, the toy gun 800 includes a slidable pump mechanism 842. The slidable pump mechanism 842 is slidably connected to the frame 802. An elastic cord, e.g., a rubber band, connects the slidable pump mechanism 842 to a trigger cover 840. A flexible arm 832 is coupled to the slidable pump mechanism 842 and extends toward the handle 808. The flexible arm 832 is positioned adjacent to and between the frame and an arm 836 of a shot bracket 830.

The toy gun 800 also includes a motor (not shown) that is similar to the motor 208 illustrated in FIG. 2. When activated, the motor causes the first gear 816 to rotate, as described below. A more detailed description of the motor is provided above, with respect to FIG. 2.

Figure 9:
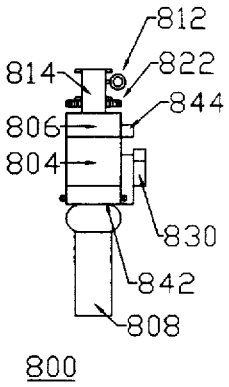
FIG. 9 is a front plan view of the second embodiment of the present invention.
Figure 10:
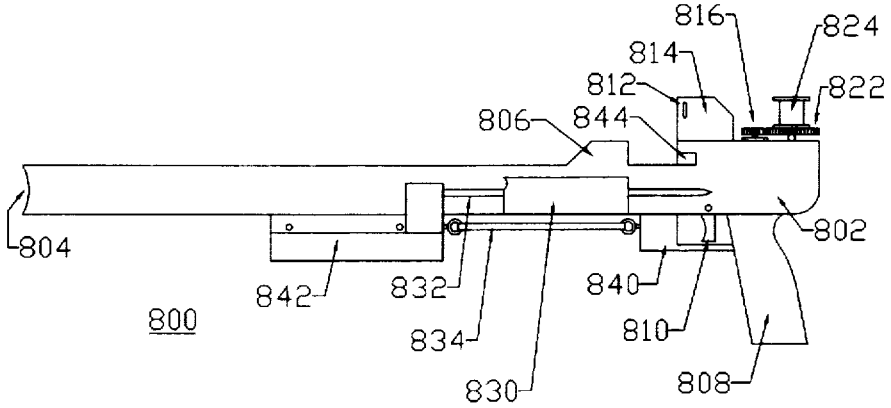
FIG. 10 is a side plan view of the second embodiment of the present invention.

FIG. 9 is a front plan view of the second embodiment of the present invention. FIG. 10 is a side plan view of the second embodiment of the present invention.

Figure 11:
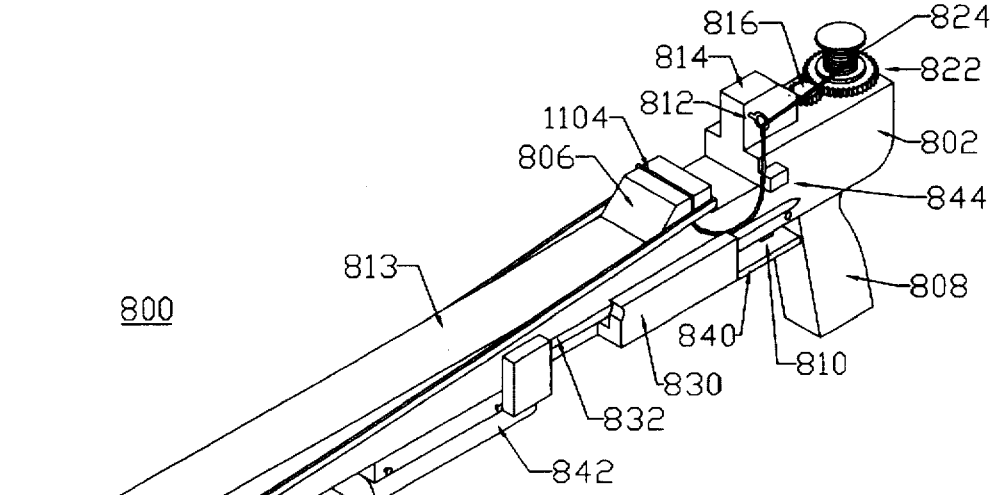
FIG. 11 is a top front and perspective view of the second embodiment of the present invention after securing the initial elastic ring thereon.

The technique for loading and shooting the second embodiment of the present invention is now described with reference to FIGS. 11–13. FIG. 11 is a top front and perspective view of the second embodiment of the present invention after securing the first elastic ring 1102, e.g., rubber band, thereon. The first rubber band 1102 is loaded using a technique that is similar to the loading technique described above with reference to FIG. 5. One end of string 1104 is secured to the spool, as described above, and the other end of the string 1104 is threaded through the ring 812 and placed (looped) across the loading block 806. The first rubber band 1102 is loaded by stretching and securing it around the loading block 806 and the muzzle 804, as illustrated in FIG. 11.

Figure 12:
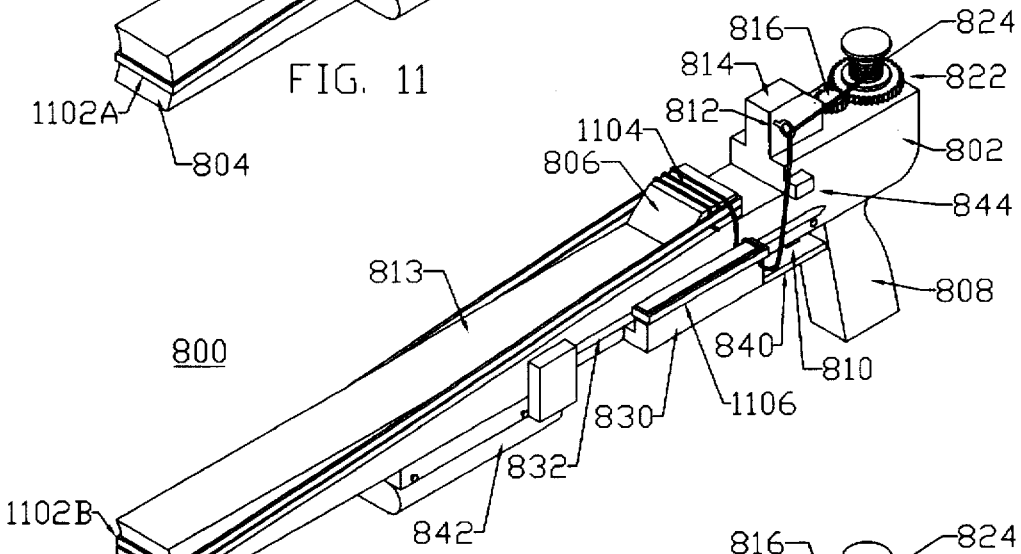
FIG. 12 is a top front and perspective view of the second embodiment of the present invention after securing a first set of elastic rings thereon and securing a first shotgun restrainer.

FIG. 12 is a top front and perspective view of the second embodiment of the present invention after securing a first set of rubber bands and securing a first shotgun restrainer. Additional rubber bands are loaded using the technique described above with reference to FIGS. 6 and 7. In the second embodiment of the toy gun 800 only a predetermined number of rubber bands 1102 will be shot during a single trigger pulse. After this predetermined number of rubber bands, i.e., the first set, are shot, a second set of rubber bands 1102 can be shot only after the slidable pump mechanism 842 is slid toward the muzzle, i.e., in the unlocked position, as described below.

In order to effectuate this result, after the first set of rubber bands 1102 is loaded, the portion of the string 1104 located between the last loaded rubber band 1102 and the ring 812 is looped under the flexible arm 832 and placed across the shot bracket 830, as illustrated in FIG. 12. A rubber band 1106 is placed across the shot bracket 830 to secure the string thereon. Thereafter a second set of rubber bands 1102 are loaded onto the toy gun 800, as described below.

Figure 13:
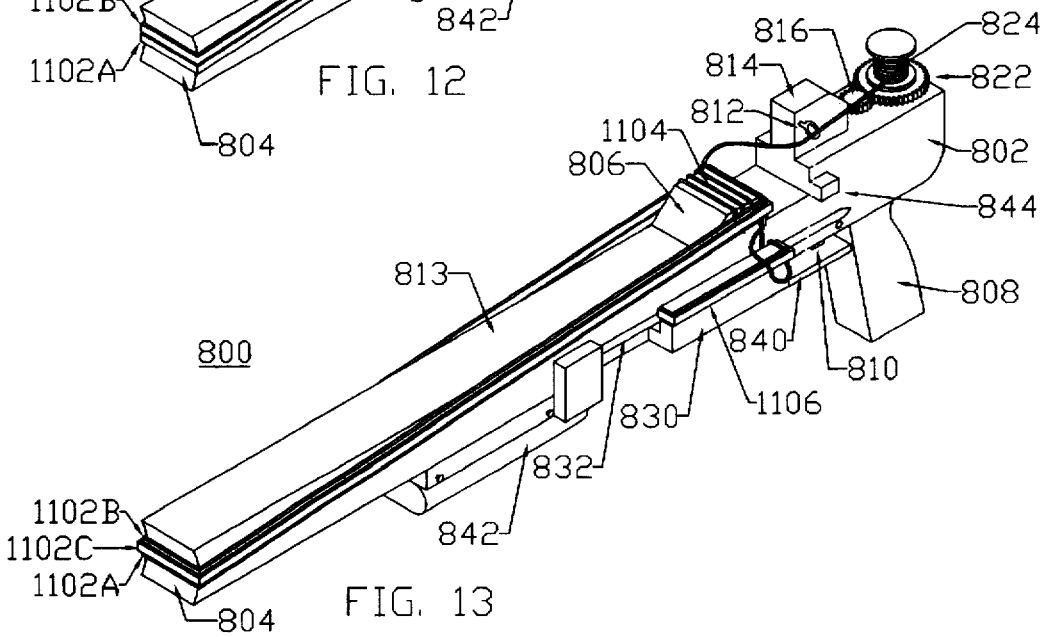
FIG. 13 is a top front and perspective view of the second embodiment of the present invention after securing a second set of elastic ring thereon.

FIG. 13 is a top front and perspective view of the second embodiment of the present invention after securing a second set of rubber bands 1102 thereon. The technique for securing the second set of rubber bands 1102 is the same as securing the first set of rubber bands, as described above. After the second set of rubber bands 1102 is loaded, the string 1104 can be looped around the flexible arm 834 and secured to the shot bracket 830, as described above with reference to FIG. 12. Alternatively, only two sets of rubber bands 1102 are loaded, as illustrated in FIG. 13, and the toy gun 800 can be activated.

The operation of the second embodiment of the toy gun 800 is now described. After loading the toy gun 800 with two sets of rubber bands 1102, the user presses the trigger 810 causing the spool 824 to rotate in the manner described above with reference to FIGS. 1–7. In the second embodiment, the discharge rate is approximately fifty rubber bands 1102 per second. As discussed below, this rate can differ based upon the speed of the motor and the gear ratio. The second set of rubber bands 1102, i.e., the rubber bands loaded last, is shot as the string 1104 wraps around the spool 824 and sequentially pulls each rubber band in the second set over the upper edge of the loading block 806, as described above with respect to the first embodiment of the toy gun 100. After the second set of rubber bands 1102 is shot the spool 824 continues to pull the string 1104 and the rubber band 1106 on the shot bracket 830 is discharged. Thereafter, since the string 1104 is looped around the flexible arm 832, the string 1104 pulls the flexible arm upward until the flexible arm 832 is stopped by the stopper 844. Accordingly, no more rubber bands are shot when the toy gun 800 is in this position.

When the flexible arm 832 is in contact with the stopper 844 the spool 824 is unable to rotate because the string 1104 is secured by the flexible arm 832. In order to shoot the first set of rubber bands 1102, the user must slide the slidable pump mechanism 842 toward the muzzle 804 until the end of the flexible arm 832 is positioned such that the string that is looped around the flexible arm 832 slides off the end of the flexible arm 832, i.e., the unlocked position, and the flexible arm 832 returns to its original position adjacent to the base of the shot bracket 830, i.e., the locked position. Since the string is no longer impeded by the flexible arm 832, the spool 824 can rotate in response to the pulling of the trigger 810 and the first set of rubber bands 1102 is shot. Each set of rubber bands can contain any number of rubber bands 1102. In addition, many sets of rubber bands 1102 can be loaded onto the toy gun 800.

In a third embodiment of the present invention (not illustrated) the frame 102, 802 includes a removable magazine. The rubber bands are loaded onto the removable magazine. The possible shapes of the removable magazine include rectangular, cylindrical, and star shaped, i.e., cylindrical with elongated members protruding radially therefrom. When secured to the frame, string is secured to a spool and the user operates the toy gun in the manner described above.

While the invention has been particularly shown and described with reference to preferred embodiments, it will be understood by persons skilled in the relevant art that various changes in form and details can be made therein without departing from the spirit and scope of the invention.

What is claimed is:

1. A toy gun for shooting elastic rings, said toy gun comprising:

a base having a first end and a second end upon which the elastic rings are stretched and operably mounted;

a motor;

a spool, having a wrapping portion, rotatably mounted on said base and rotatably responsive to said motor;

a string, a first portion of said string positioned around said wrapping portion, a second portion of said string interwovenly positioned between said second end and each of the elastic rings, said string being forcibly wrapped around said spool in response to the operation of said motor causing the elastic rings to dismount from said second end; and a gear assembly, coupled to said spool, for causing said spool to rotate in response to said motor.

2. A toy gun for shooting elastic rings, said toy gun comprising:

a base having a first end and a second end upon which the elastic rings are stretched and operably mounted;

a motor;

a spool, having a wrapping portion, rotatably mounted on said base and rotatably responsive to said motor;

a string, a first portion of said string positioned around said wrapping portion, a second portion of said string interwovenly positioned between said second end and each of the elastic rings, said string being forcibly wrapped around said spool in response to the operation of said motor causing the elastic rings to dismount form said second end; and a trigger mechanism for activating said motor, wherein said trigger mechanism is adapted to be activated and supported by a single hand of a user.

3. A toy gun for shooting elastic rings, said toy gun comprising:

a base having a first end and a second end upon which the elastic rings are stretched and operably mounted;

a motor;

a spool, having a wrapping portion, rotatably mounted on said base and rotatably responsive to said motor;

a string, a first portion of said string positioned around said wrapping portion, a second portion of said string interwovenly positioned between said second end and each of the elastic rings, said string being forcibly wrapped around said spool in response to the operation of said motor causing the elastic rings to dismount from said second end; and a slidable pumping mechanism for stopping additional movement of the string after a first predetermined number of elastic rings are dismounted when said slidable pumping mechanism is in a locked position, and for permitting a second predetermined number of elastic rings to dismount after said slidable pumping mechanism is positioned in an unlocked position.

4. The toy gun of claim 3, wherein said second end of said base is removable.

5. A method for loading and discharging at least one elastic ring, said method comprising the steps of:

securing a first end of a string to a spool;

placing a second end of said string on a first end of a base;

securing the elastic ring by stretching the elastic ring over said first end of said base and a second end of said base;

engaging an activation mechanism to activate a motor;

discharging the elastic ring, after activating said motor, said spool rotatably responsive to said motor, said string wrapping around said spool in response to said motor, said elastic ring discharging when said string releases the elastic ring from the first end of said base.

6. The method of claim 5, further comprising the step of:

repeating said placing step and said securing step for each of a plurality of elastic rings.

7. A toy gun for shooting elastic rings, said toy gun comprising:

a base having a first end and a second end upon which the elastic rings are stretched and operably mounted;

a motor;

an activation mechanism, coupled to said motor, for activating said motor;

a spool, having a wrapping portion, rotatably mounted on said base and rotatable responsive to said motor; and a string, a first portion of said string positioned around said wrapping portion, a second portion of said string interwovenly positioned between said second end and each of the elastic rings, said string being forcibly wrapped around said spool, in response to activation of said motor, causing the elastic rings to dismount from said second end.

8. The toy gun of claim 7, further comprising:

a gear assembly, coupled to said spool, for causing said spool to rotate in response to activation of said motor.

9. The toy gun of claim 7, wherein said activation mechanism is adapted to be engaged and supported by a single hand of a user.

10. The toy gun of claim 7, further comprising:

a slidable pumping mechanism for stopping additional movement of the string after a first predetermined number of elastic rings are dismounted when said slidable pumping mechanism is in a locked position, and for permitting a second predetermined number of elastic rings to dismount after said slidable pumping mechanism is positioned in an unlocked position.

11. The toy gun of claim 7, wherein said second end of said base is removable.

12. A toy gun for shooting elastic rings, said toy gun comprising:

base means, having a first end and a second end upon which the elastic rings are stretched and operably mounted;

a motor;

activation means, coupled to said motor, for activating said motor;

wrapping means, having a wrapping portion, rotatably mounted on said base means and rotatably responsive to said motor; and string means, a first portion of said string means positioned around said wrapping means, a second portion of said string means interwovenly positioned between said second end and each of the elastic rings, said string means being forcibly wrapped around said wrapping means in response to the operation of said motor causing the elastic rings to dismount from said second end.

13. The toy gun of claim 12, further comprising:

a gear assembly means, coupled to said wrapping means, for causing said wrapping means to rotate in response to said motor.

14. The toy gun of claim 13, wherein said activation means is adapted to be engaged and supported by a single hand of a user.

15. The toy gun of claim 13, further comprising:

a slidable pumping means, coupled to said base means, for stopping additional movement of the string after a first predetermined number of elastic rings are dismounted when said slidable pumping mechanism is in a locked position, and for permitting a second predetermined number of elastic rings to dismount after said slidable pumping mechanism is positioned in an unlocked position.

16. The toy gun of claim 15, wherein said second end of said base means is removable.

* * * * *